United States Patent [19]

Romero, Jr.

[11] Patent Number: 4,991,518

[45] Date of Patent: Feb. 12, 1991

[54] COMPUTER WORK TABLE

[76] Inventor: Fernando A. Romero, Jr., 1795 Messina Dr., San Jose, Calif. 95132

[21] Appl. No.: 451,647

[22] Filed: Dec. 18, 1989

[51] Int. Cl.[5] ..... A47B 41/04

[52] U.S. Cl. ..... 108/32; 312/233

[58] Field of Search ..... 312/233, 208; 108/32, 108/59; 211/42, 43

[56] References Cited

U.S. PATENT DOCUMENTS 2,644,588 7/1953 Brown ..... 312/233

3,016,650 1/1962 Magers ..... 108/32

*Primary Examiner*—Kenneth J. Dorner

*Assistant Examiner*—Gerald A. Anderson

*Attorney, Agent, or Firm*—Leon Gilden

[57] ABSTRACT

An apparatus is set forth wherein plural pairs of aligned support legs mount a matrix of braces therebetween. A fixed shelf surmounts the first plural pair of legs, each of a first length, overlying an angulated reading table which can be adjusted to various angles. The reading table in turn overlies a sliding table mounted within "U" shaped channels for securement of a computer keyboard and the like thereon. This sliding table can be adjusted in an up or down manner to make it more comfortable to use. A series of three fixed shelves is positioned in alignment with an adjacent shelf of the first plural pairs of legs for receiving additional computer equipment thereon. The angulated reading shelf includes a lower securement cylinder to assist in positioning material thereon, as well as including clip means in association with retracting spools for securement of various reading material positioned upon the shelf. Optionally, a positioning bar secured to the spools by tether lines is mounted for securement of the reading material upon the shelf.

4 Claims, 4 Drawing Sheets

COMPUTER WORK TABLE

BACKGROUND OF THE INVENTION

1. Field of the Invention

The field of invention relates to computer tables, and more particularly pertains to a new and improved computer work table wherein the same is provided with aligned shelves for securement of equipment thereon.

2. Description of the Prior Art

The prior art has provided tables and supports for work stations and for use with computers, as is required in contemporary work settings. Tables of the prior art have heretofore been of various configurations to adapt to particular needs. Examples of the prior art include U.S. Design patent 279,740 to Slager, U.S. Design patent 285,394 to Curran, et al., U.S. Design patent 288,157 to Sandor, U.S. Design patent 289,114 to Dickson, and U.S. Design patent 293,284 to Wright, et al. The table construction of the instant invention attempts to overcome deficiencies of the prior art by providing a computer work station in coordination with operative structure to secure reading material in a position above a sliding table to thusly enable an individual to readily be provided with sight positioning or reading material in coordination with equipment positioned upon the table structure.

As such, it may be appreciated that there is a continuing need for a new and improved computer work table which addresses both the problems of ease of use and effectiveness in construction and in this respect, the present invention substantially fulfills this need.

SUMMARY OF THE INVENTION

In view of the foregoing disadvantages inherent in the known types of computer work stations now present in the prior art, the present invention provides a computer work table wherein the same provides for a matrix of shelves and bracing to structurally position a reading shelf in advantageous relationship to an underlying sliding table to enhance use of the work table in a computer working environment. As such, the general purpose of the present invention, which will be described subsequently in greater detail, is to provide a new and improved computer work table which has all the advantages of the prior art computer work stations and none of the disadvantages.

To attain this, the present invention comprises an apparatus wherein plural pairs of aligned support legs mount a matrix of braces therebetween. A fixed shelf surmounts the first plural pair of legs, each of a first length, overlying an angulated reading table which can be adjusted to various angles. The reading table in turn overlies a sliding table mounted within "U" shaped channels for securement of a computer keyboard and the like thereon. The sliding table can be adjusted in an up or down manner to make it more comfortable to use. A series of three fixed shelves is positioned in alignment with an adjacent shelf of the first plural pairs of legs for receiving additional computer equipment thereon. The angulated reading shelf includes a lower securement cylinder to assist in positioning material thereon, as well as including clip means in association with retracting spools for securement of various reading material positioned upon the shelf. Optionally, a positioning bar secured to the spools by tether lines is mounted for securement of the reading material upon the shelf.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved computer work table which has all the advantages of the prior art computer work stations and none of the disadvantages.

It is another object of the present invention to provide a new and improved computer work table which may be easily and efficiently manufactured and marketed.

It is a further object of the present invention to provide a new and improved computer work table which is of a durable and reliable construction.

An even further object of the present invention is to provide a new and improved computer work table which is susceptible of a low cost of manufacture with regard to both materials and labor, and which accordingly is then susceptible of low prices of sale to the consuming public, thereby making such computer work tables economically available to the buying public.

Still yet another object of the present invention is to provide a new and improved computer work table which provides in the apparatuses and methods of the prior art some of the advantages thereof, while simultaneously overcoming some of the disadvantages normally associated therewith.

Still another object of the present invention is to provide a new and improved computer work table wherein the same enables positioning of various reading material secured upon a reading table angularly positioned relative to a work station of the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
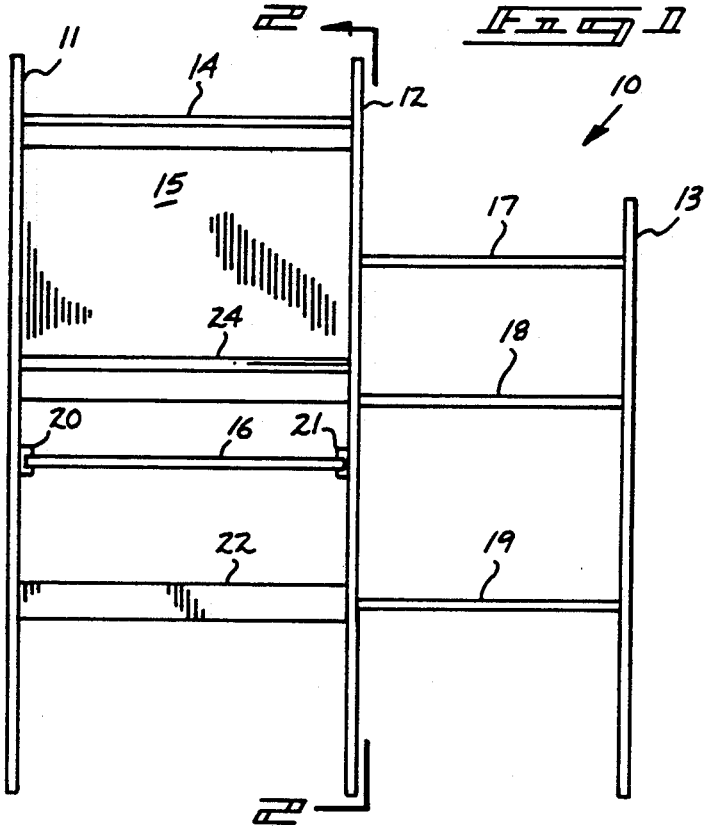
FIG. 1 is a frontal orthographic view taken in elevation of the instant invention.

With reference now to the drawings, and in particular to FIGS. 1 to 8 thereof, a new and improved computer work table embodying the principles and concepts of the present invention and generally designated by the reference numeral 10 will be described.

Figure 2:
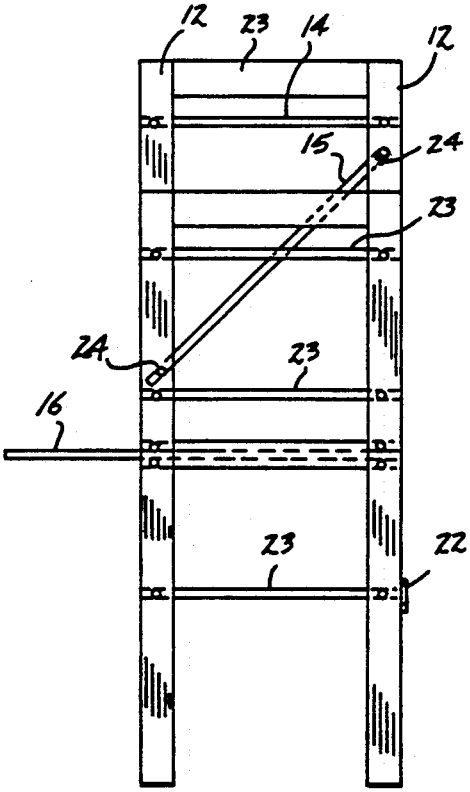
FIG. 2 is an orthographic view taken along the lines 2—2 of FIG. 1 in the direction indicated by the arrows.

More specifically, the computer work table 10 of the instant invention essentially comprises plural pairs of support legs comprising a first leg pair 11 spaced from and parallel to a second leg pair 12, wherein the first and second leg pair 11 and 12 are of a first height parallel to and spaced from a third leg pair 13 of a second and lesser height than that defined by the first and second leg pair. The first, second, and third leg pairs are each aligned, as well as parallel to one another. Between the first and second leg pairs 11 and 12 mounted adjacent upper ends thereof in an othogonal relationship intermediate the leg pairs 11 and 12 is a first top shelf 14 spaced above an angulated reading shelf 15 which can be adjusted and secured at various angles relative to the top shelf 14 with a horizontal sliding shelf 16 underlying the reader shelf 15 and slidably mounted between a first and second "U" shaped channel 20 and 21 that are orthogonally, coextensively, and integrally mounted interiorly of the first and second leg pairs 11 and 12, as well as effecting bracing of the leg pairs. The slidable shelf and "U" shaped channels can be mounted in various positions near or lower from the reading table. As illustrated in FIGS. 1 and 2, the first "U" shaped channel 20 is mounted interiorly of the first leg par—with the second "U" shaped channel 21 mounted interiorly of the second leg pair 12 to slidably receive the sliding or bottom shelf 16 therebetween. The third leg pair 13 includes a first, second, and third horizontal shelf 17, 18, and 19 respectively, wherein the shelves are integrally and orthogonally mounted to the third leg pair 13 at their forward ends and integrally mounted to the second leg pair at their rearward ends, as illustrated in FIG. 1 for example. A bottom brace 22 integrally associates the first and second leg pairs 11 and 12 underlying the horizontal sliding shelf 16 and aligned with the third horizontal shelf 19 to effect structural integrity of the organization, as well as a series of side braces 23 integrally and orthogonally mounted between adjacent pairs of first and second leg pairs, as exemplified in FIG. 2 for example.

The angulated reader shelf 15, as illustrated in FIGS. 1 and 2 for example, utilize a support bar 24 overlying the shelf 15 adjacent a lowermost edge thereof and secured between the forward first and second leg pair 11 and 12 of the respective pairs of leg pairs to provide a bottom support ledge for associated reading material surmounted upon the shelf 15. As illustrated, the reader shelf 15 is mounted between the spaced leg pairs 11 and 12 utilizing conversion fastening means available to one of ordinary skill in the art.

Figure 3:
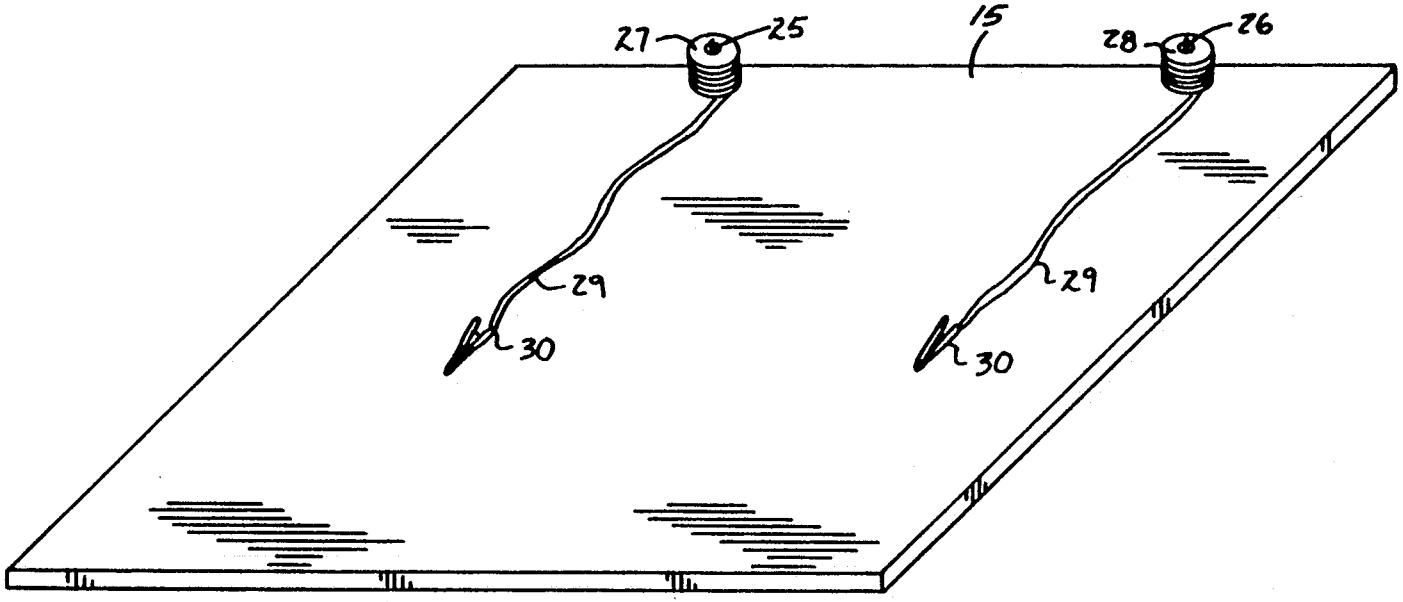
FIG. 3 is an isometric illustration of the reading shelf of the instant invention.
Figure 4:
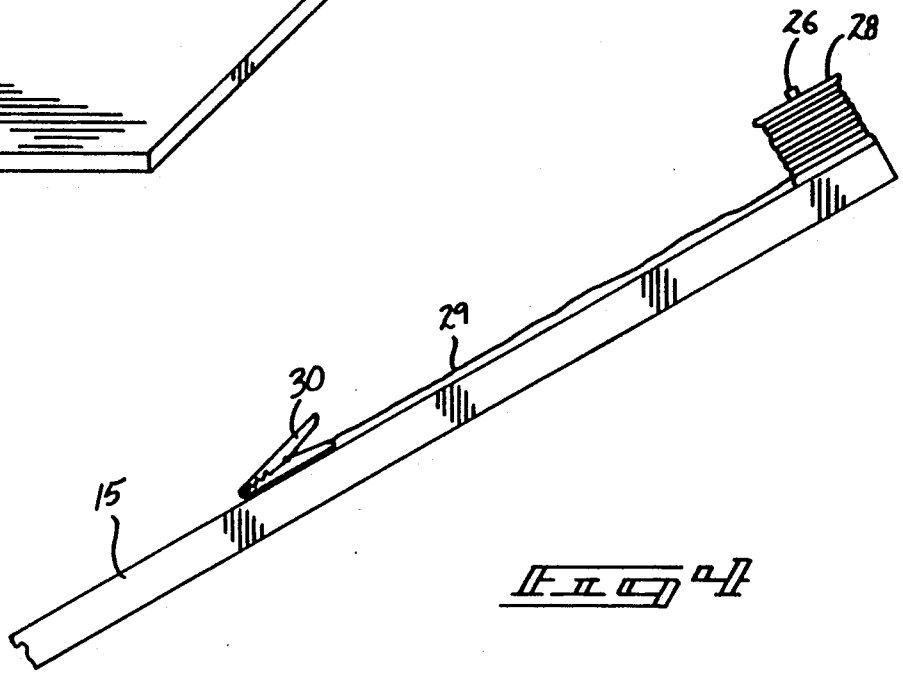
FIG. 4 is an orthographic side view of the reading shelf, as illustrated in FIG. 3.

Reference to FIGS. 3 and 4 illustrates the reader shelf 15 with associated reader support material comprising a first and second spindle 25 orthogonally and integrally mounted adjacent an upper edge of the shelf 15 that defines a diameter to frictionally engage an interior bore of an associated first and second spool 28 to thereby maintain positioning of the spools 27 and 28 respective to the first and second spindles 25 and 26 to provide securement of a reading article at a predetermined orientation to the upper surface of the shelf 15. The spools 27 and 28 each include a flexible tether line of a finite length wound thereabout, wherein each tether line at its forward terminal end includes a spring-biased securement engagement clip 30 for securement of reading material therewithin.

Figure 5:
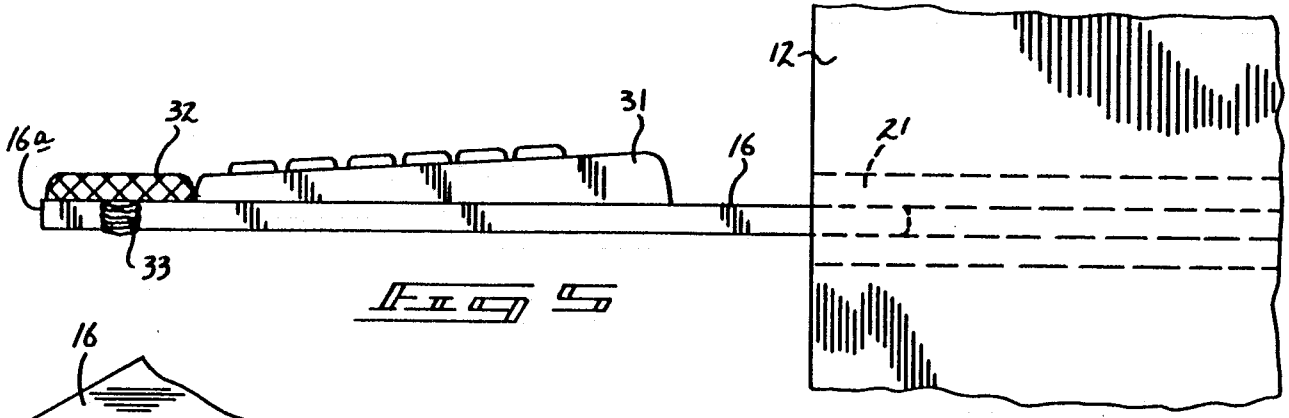
FIG. 5 is an orthographic side view taken in elevation of the sliding shelf in an extended orientation relative to the cabinetry.
Figure 6:
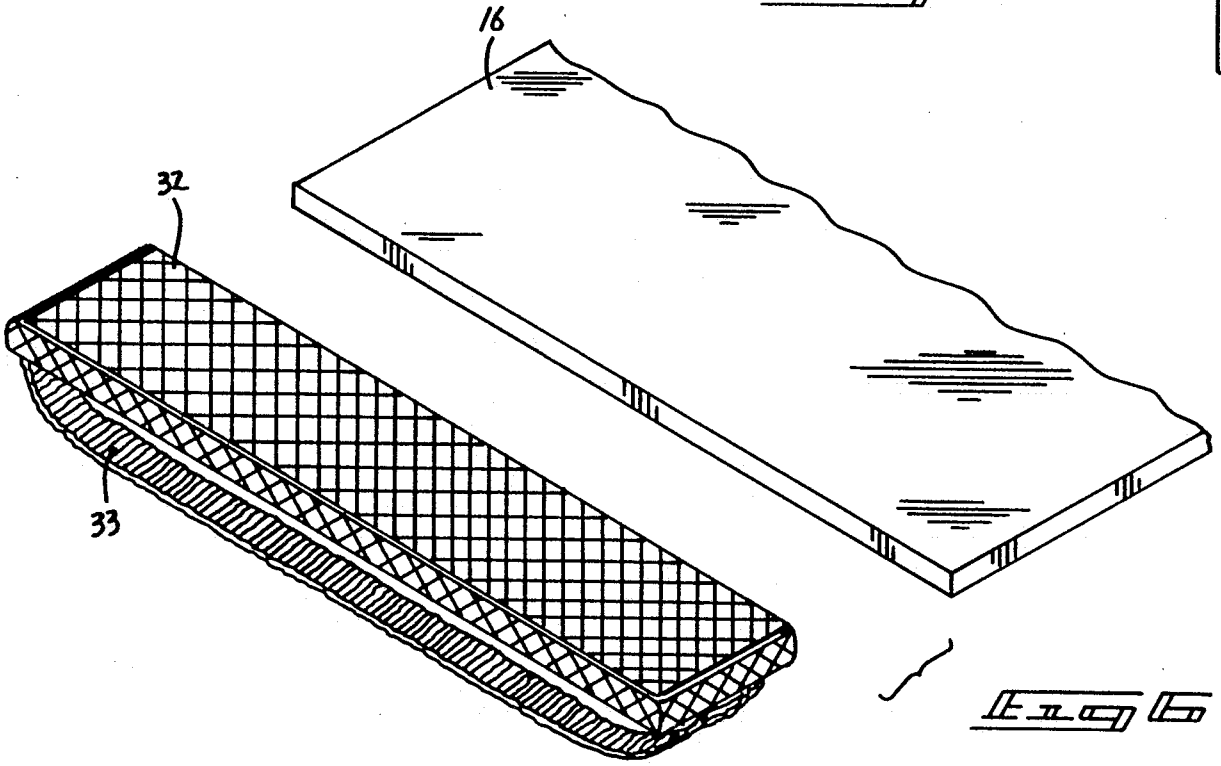
FIG. 6 is an isometric illustration of the sliding shelf and associated removable pad associated therewith.

FIGS. 5 and 6 illustrate the sliding shelf 16 with an associated computer keyboard 31 mounted thereon. The computer keyboard 31 is positioned spaced from a forward edge **16*a* of the self 16 to define the distance therebetween to receive an elongate resilient cushion 32 coextensive with the predetermined width of the shelf 16 and mounted adjacent and contiguous with the forward edge 16*a*. An elastic band 33 engages the lower lateral edges of the cushion 32 in surrounding relationship relative to the shelf 16 to secure the cushion 32 in position and subsequently enable its removal for cleaning and associated replacement thereof, if necessary. The cushion 32** enables an individual to rest their hand and wrist portions thereon during a typing procedure to enhance ease of use of the organization.

Figures 7, 8:
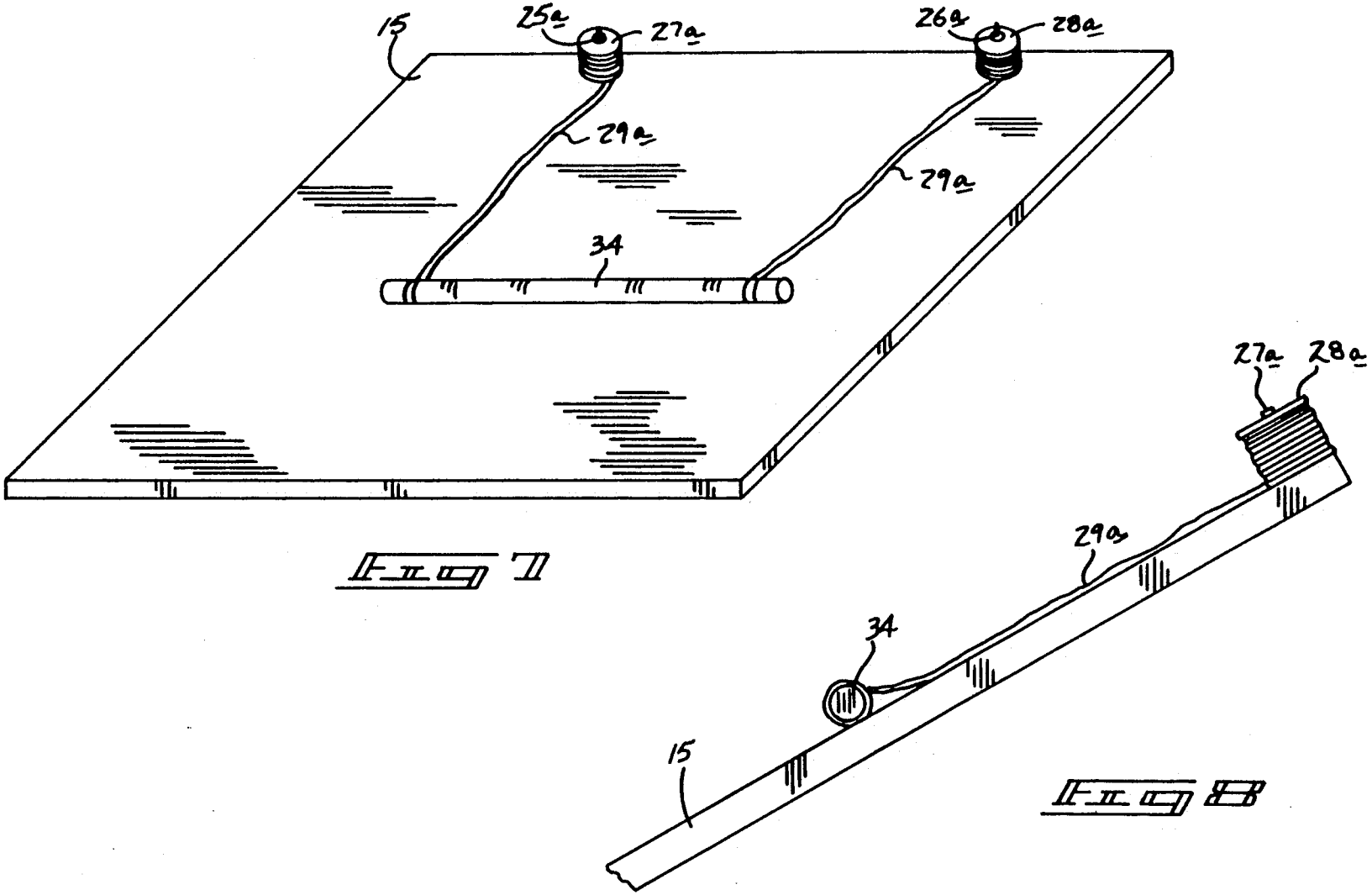
FIG. 7 is an isometric illustration of a modified reading shelf of the instant invention.
FIG. 8 is an orthographic side view taken in elevation of the reading shelf of FIG. 7.

FIGS. 7 and 8 illustrate a modified reader shelf construction 15 that includes a first and second spindle **25*a* and 26*a* to frictionally engage an interior bore of a respective first and second spool 27*a* and 28*a* including a finite length of tether line 29*a* wound about each spool, in a manner as set forth in the embodiment of FIGS. 3 and 4, but wherein a metallic securement cylinder 34 is fixedly secured to the forward terminal ends of each of the tether lines 29*a* to enable securement of reading material positioned upon the upper surface of the shelf 15**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letter patent of the United States is as follows:

1. A computer work table for securement of equipment thereof including a keyboard, the table comprising, a first pair of support legs spaced from and parallel to a second pair of support legs, wherein the second pair of support legs are spaced from and parallel to a third pair of support legs, and wherein each of the individual legs of the first, second, and third pairs of support legs are each aligned relative to one another defining a matrix of support legs, wherein the first and second pairs of support legs are of a first height, and wherein the third pair of support legs are of a second height less than the first height, and a top shelf integrally mounted to and orthogonally oriented between the first and second pairs of support legs coextensive therewith, and an angular reader shelf underlying the top shelf, wherein the angular reader shelf is secured to define an acute angle relative to the top shelf, and a bottom shelf underlying the angulated reader shelf, the bottom shelf slidably mounted between the first and second pairs of support legs, and a plurality of shelves integrally secured between the second and third pairs of support legs, wherein the plurality of shelves are each parallel relative to one another, and further including a plurality of braces between each of the individual legs of the first and second pairs of support legs to secure the legs together and maintain geometric integrity thereof, and wherein the reader shelf includes a forward edge oriented below a top edge of the reader shelf, and the reader shelf further including a support bar integrally and orthogonally mounted between forward legs of each of the first and second pairs of support legs, wherein the support bar is positioned adjacent the forward edge of the reader shelf in contact therewith, and wherein the reader shelf includes a first spindle and a second spindle, the spindles orthogonally and integrally mounted adjacent the rear edge of the reader shelf, and further including a respective first and second spook wherein the first and second spool each includes an axial bore directed therethrough, wherein each axial bore of the first and second spools is mounted in frictional engagement with the first and second spindle respectively, the first and second spools mounting securement means for securement of reading material onto an upper surface of the reader shelf.

2. A computer work table as set forth in claim 1 wherein the securement means includes a first elongate tether line wound about the first spool, and a second elongate tether line wound about the second spool, the forward terminal edges of each of the first and second tether lines including a springbiased securement clip integrally affixed thereto.

3. A computer work table as set forth in claim 2 wherein the keyboard is positioned in a spaced relationship relative to a forward edge of the sliding shelf, and further including an elongate resilient cushion positioned between the forward edge of the sliding shelf and the keyboard and coextensively formed to the forward edge of the sliding shelf, and further including an elastic band fixedly secured to lower lateral edges defined by the resilient cushion, wherein the elastic band is in surrounding engagement to the sliding shelf, wherein the resilient cushion and the elastic band encompass the sliding shelf.

4. A computer work table as set forth in claim 2 wherein the securement means includes a first tether line wound about the first spool and a second tether line wound about the second spool, and an elongate metallic securement cylinder secured to forward terminal ends of the first and second tether lines overlying an upper surface of the reader shelf for frictional engagement of reading material mounted between the securement cylinder and the upper surface of the reader shelf.

* * * * *